US007868533B2

(12) United States Patent
Jeon

(10) Patent No.: US 7,868,533 B2
(45) Date of Patent: Jan. 11, 2011

(54) ELECTRON EMISSION DISPLAY AND METHOD OF FABRICATING THE SAME

(75) Inventor: Sang-Ho Jeon, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 1060 days.

(21) Appl. No.: 11/546,780

(22) Filed: Oct. 11, 2006

(65) Prior Publication Data

US 2007/0085462 A1 Apr. 19, 2007

(30) Foreign Application Priority Data

Oct. 17, 2005 (KR) ..... 10-2005-0097705

(51) Int. Cl.
*H01J 1/62* (2006.01)

(52) U.S. Cl. ..... 313/496; 445/24

(58) Field of Classification Search ..... 313/495, 313/496, 497; 445/13, 24, 40, 49–51
See application file for complete search history.

(56) References Cited

U.S. PATENT DOCUMENTS 6,812,636 B2 * 11/2004 Porter et al. ..... 313/496
2005/0134169 A1 * 6/2005 Hwang ..... 313/496
2005/0212401 A1 * 9/2005 Hirasawa et al. ..... 313/495

* cited by examiner

*Primary Examiner*—Joseph L Williams
*Assistant Examiner*—Andrew J Coughlin
(74) *Attorney, Agent, or Firm*—Christie, Parker & Hale, LLP

(57) ABSTRACT

An electron emission display includes a first substrate, an electron emission unit formed at the first substrate to emit electrons, a second substrate facing the first substrate, and a light emission unit formed at the second substrate to emit visible light using electrons emitted from the electron emission unit. The light emission unit includes a phosphor layer formed on the second substrate and an anode electrode formed on the phosphor layer. The anode electrode includes a first metal layer and a second metal layer formed on the first metal layer and having a single- or multi-layered structure.

14 Claims, 8 Drawing Sheets

ELECTRON EMISSION DISPLAY AND METHOD OF FABRICATING THE SAME

CROSS-REFERENCE TO RELATED APPLICATION

The present application claims priority to and the benefit of Korean Patent Applications No. 10-2005-0097705, filed on Oct. 17, 2005, in the Korean Intellectual Property Office, the entire content of which is incorporated herein by reference.

BACKGROUND OF THE INVENTION

1. Field of the Invention

The present invention relates to an electron emission display, and more particularly to an electron emission display in which a structure of an anode electrode is improved to increase light emission efficiency, a process for forming the anode electrode, and a method of fabricating the electron emission device.

2. Description of Related Art

An electron emission display is a self-light-emitting display using electrons emitted from an electron emission device having a plurality of electron emission elements.

Generally, electron emission elements can be classified into those using hot cathodes as an electron emission source and those using cold cathodes as the electron emission source.

Cold cathode electron emission elements include Field Emitter Array (FEA) elements, Surface Conduction Emitter (SCE) elements, Metal-Insulator-Metal (MIM) elements, and Metal-Insulator-Semiconductor (MIS) elements.

A typical electron emission display includes first and second substrates facing each other. Electron emission regions (or elements) are formed on (or over) the first substrate. The first and second substrates are sealed together at their peripheries using a sealing material such as frit, and the inner space between the substrates is exhausted to form a vacuum vessel (or chamber).

The electron emission display further includes driving electrodes formed on the first substrate to control the electron emission for each of the pixels. The electron emission display further includes phosphor layers (and black layers) formed on (or under) the second substrate, and an anode electrode formed on (or under) the second substrate to allow the electrons emitted from the electron emission regions formed on the first substrate to be effectively accelerated toward the phosphor layers. Accordingly, the electrons emitted from the electron emission regions collide with the phosphor layers to emit light and/or display an image.

Here, the anode electrode is formed of a metal such as aluminum. The anode electrode is disposed on (or under) the phosphor layers and the black layers to heighten the screen luminance by reflecting the visible light rays radiated from the phosphor layers to the first substrate toward the second substrate.

In order to form the anode electrode, a metal layer for the anode electrode is initially formed through a sputtering process or a vapor deposition process on an organic layer, which is an intermediate layer formed on the phosphor layers, and then the intermediate layer is fired.

However, the anode electrode may be damaged and cracked (e.g., to include hairline cracks) due to a high temperature generated during the firing process of the intermediate layer.

The cracks of the anode electrode deteriorate the reflection efficiency of the visible rays and thus the luminance and color reproduction ability of the electron emission display are lowered. Furthermore, the cracks of the anode electrode deteriorate the reliability of the anode electrode and thus the service life of the anode electrode (and/or the phosphor layers) is reduced. In addition, the cracks of the anode electrode may cause a short circuit that further damages the anode electrode.

SUMMARY OF THE INVENTION

An aspect of the present invention provides an electron emission display in which a damage of an anode electrode, which may be caused by a process of firing an intermediate layer, is suppressed or compensated to improve an arc discharge characteristic and/or a display quality of the electron emission display.

In an exemplary embodiment of the present invention, there is provided an electron emission display. The electron emission display includes a first substrate, an electron emission unit formed at the first substrate to emit electrons, a second substrate facing the first substrate, and a light emission unit formed at the second substrate to emit visible light using electrons emitted from the electron emission unit. The light emission unit includes a phosphor layer formed on the second substrate and an anode electrode formed on the phosphor layer. The anode electrode includes a first metal layer and a second metal layer formed on the first metal layer and having a single-or multi-layered structure.

A gap may be formed between the anode electrode and the phosphor layer.

Each of the first and second metal layers may be formed of a metal material containing aluminum.

The phosphor layer may be divided into a plurality of sections arranged on the second substrate (e.g., at predetermined intervals), and black layers are formed between the sections of the phosphor layer.

The electron emission display may further include another anode electrode formed between the second substrate and the phosphor layer.

The anode electrode may have a thickness ranging from about 1000 to 1500 Å.

According to another exemplary embodiment, there is provided a method of fabricating an electron emission display having a first substrate at which an electron emission unit is formed and a second substrate at which a light emission unit is formed. The method includes: forming a phosphor layer at the second substrate; forming an intermediate layer on the phosphor layer; forming a first metal layer on the intermediate layer; firing the intermediate layer; and forming a second metal layer on the first metal layer.

The phosphor layer may be divided into a plurality of sections arranged on the second substrate (e.g., at predetermined intervals), and black layers are formed between the sections of the phosphor layer.

Each of the first and second metal layers may be formed of a metal material containing aluminum.

The intermediate layer may be formed of a polymer organic material.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

Figure 1:
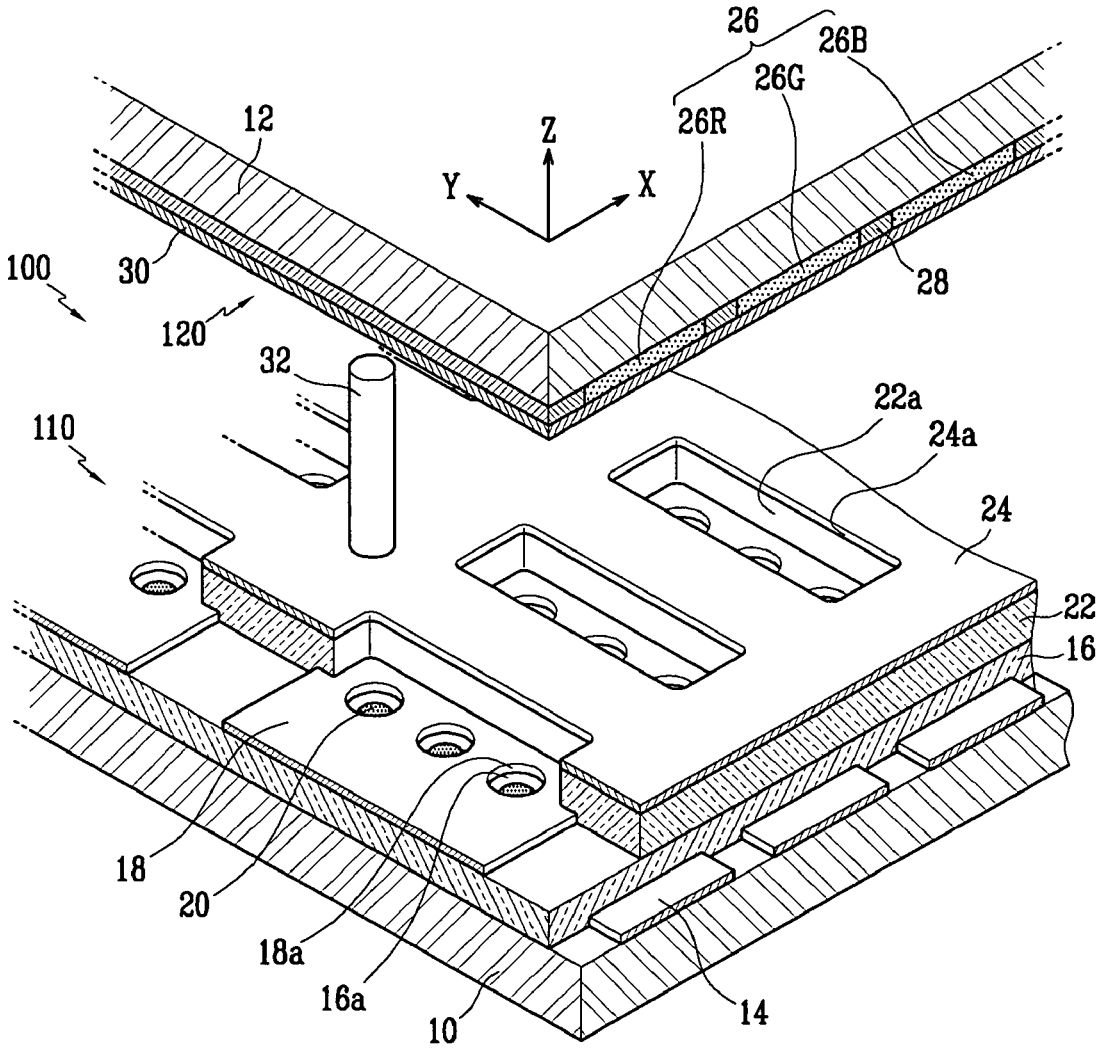
FIG. 1 is a partial perspective view of an electron emission display according to an embodiment of the present invention.
Figure 2:
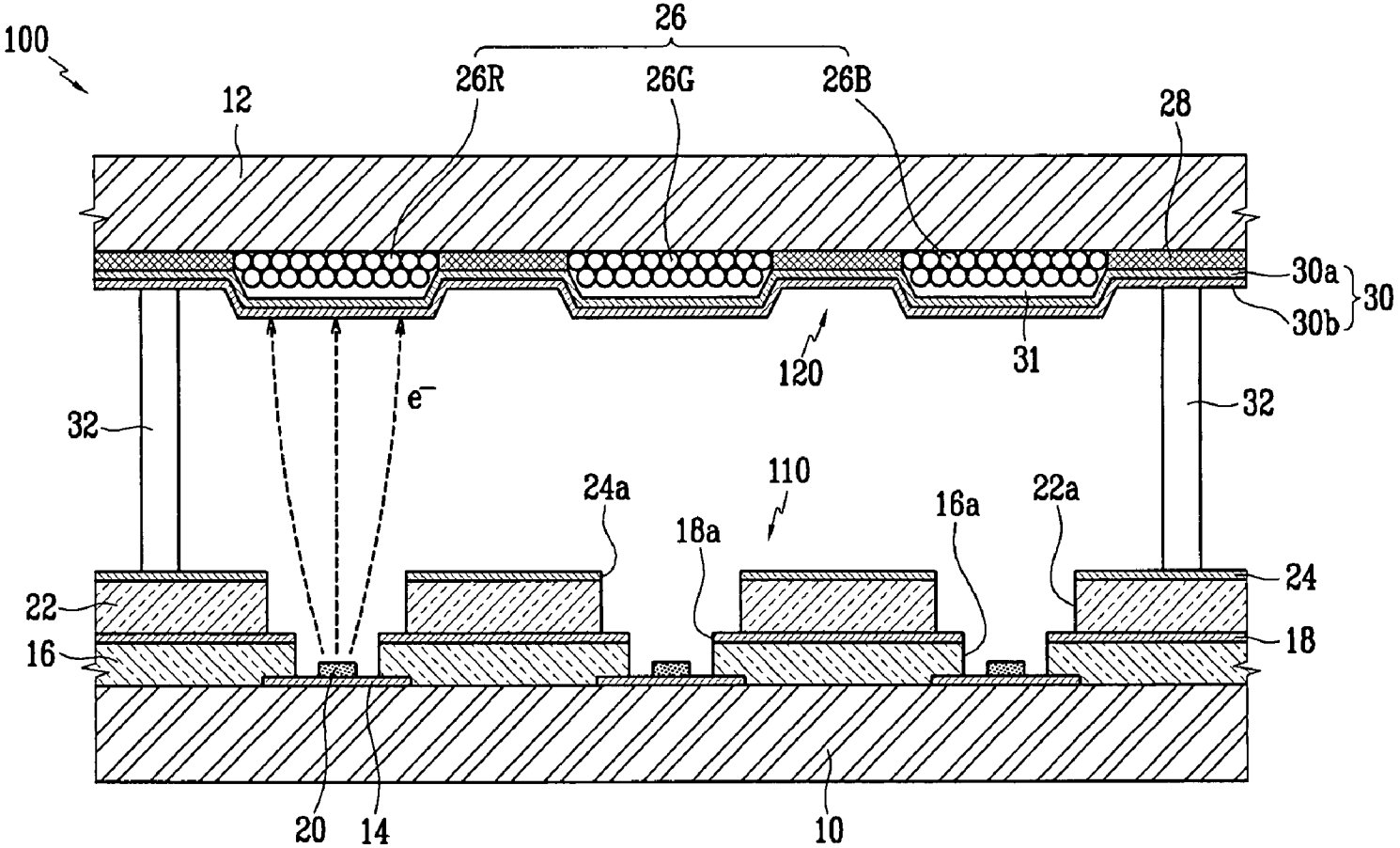
FIG. 2 is a partial sectional view of the electron emission of FIG. 1.

FIGS. 1 and 2 show an electron emission display according to an embodiment of the present invention.

Referring to FIGS. 1 and 2, an electron emission display according to an embodiment of the present invention includes a first substrate 10 and a second substrate 12. The first and second substrates 10 and 12 face each other and are spaced apart from each other with a distance therebetween. A sealing member (not shown) is provided at the peripheries of the first and the second substrates 10 and 12 to seal them together, and an inner space between the first and second substrates 10 and 12 is maintained at a vacuum of about $10^{-6}$ torr to form a vacuum chamber (or vessel).

An electron emission unit 110 for emitting electrons is formed at (on or over) a surface of the first substrate 10 facing the second substrate 12. A light emission unit 120 is provided at (on or under) a surface of the second substrate 12 facing the first substrate 10 to emit visible rays using the electrons emitted from the electron emission unit 110.

Describing the electron emission unit 110 in more detail, cathode electrodes (or first electrodes) 14 are formed on the first substrate 10 in a stripe pattern, and a first insulation layer 16 is formed on the first substrate 10 to cover the cathode electrodes 14. The cathode electrodes 14 are formed along a first direction (a direction of a y-axis in FIG. 1).

Gate electrodes (or second electrodes) 18 are formed on the insulation layer 16. The gate electrodes 18 are formed along a second direction (a direction of an x-axis in FIG. 1) to cross the cathode electrodes 14 (e.g., to cross the cathode electrodes 14 at right angles).

The crossed regions of the cathode electrodes 14 and the gate electrodes 18 define pixel regions. Each of the pixel regions has one or more electron emission regions 20. Openings 16*a* and 18*a* corresponding to the electron emission regions 20 are formed through the first insulation layer 16 and the gate electrodes 18 to expose the electron emission regions 20. The electron emission regions 20 are formed of a material that emits electrons when an electric field under a vacuum atmosphere is applied thereto. The material can be a carbonaceous material and/or a nanometer-sized material. For example, the electron emission regions 20 can be formed of carbon nanotubes, graphite, graphite nanofibers, diamonds, diamond-like carbon, $C_{60}$, silicon nanowires, or combinations thereof.

Alternatively, the electron emission regions may be formed of a molybdenum-based material and/or a silicon-based material. In these cases, the electron emission regions may be formed to have a pointed tip structure.

In FIGS. 1 and 2, the electron emission regions are shown to have a cylindrical shape and arranged in series along a longitudinal direction of each of the cathode electrodes 14 at each pixel region. However, the shape, number, and arrangement of electron emission regions 20 at each of pixel regions are not thereby limited.

A second insulation layer 22 is formed on the first insulation layer 16 to cover the gate electrodes 18, and a focusing electrode (or a third electrode) 24 is formed on the second insulation layer 22. The second insulation layer 22 insulates the gate electrodes 18 from the focusing electrode 24. Openings 22*a* and 24*a* are formed in the second insulation layer 22 and the focusing electrode 24.

In one embodiment as an example, the openings 22*a* and 24*a* are provided at each of the pixel regions so that the focusing electrode 24 can focus the electrons emitted at each of pixel regions.

Describing the light emission unit 120 in more detail, phosphor layers 26, including red, green, and blue phosphor layers 26R, 26G and 26B, are formed on a surface of the second substrate 12 that is opposite to the first substrate 10, and black layers 28 are arranged between the phosphor layers 26R, 26G, and 26B.

Each of the pixel regions formed on the first substrate 10 corresponds to a single color phosphor layer of the red, green, and blue phosphor layers 26R, 26G and 26B.

An anode electrode 30 formed of a conductive material, such as aluminum, is formed on the phosphor layers 26 and black layers 28. The anode electrode 30 is applied with a high voltage to heighten the screen luminance, the high voltage being at a voltage level required for accelerating the electron beams. In addition, the anode electrode 30 heightens the screen luminance by reflecting the visible light rays radiated from the phosphor layers 26 to the first substrate 10 toward the second substrate 12.

Here, as shown in FIG. 2, the anode electrode 30 is composed of a first metal layer 30*a* and a second metal layer 30*b*. The second metal layer 30*b* is composed of a single- or multi-layered structure on the first metal layer 30*a*. In FIG. 2, although the second metal layer 30*b* is shown to be composed of a single metal layer, the present invention is not thereby limited. For example, the second metal layer may be composed of two or three metal layers. Here, the second metal layer 30*b* compensates for fine (hairline) cracks that may be formed on the first metal layer 30*a* during the fabrication process. Therefore, the anode electrode 30 has a uniform and stable structure.

In addition, a gap (or predetermined gap) 31 may be formed between the phosphor layers 26 and the first metal layer 30*a* during a process of firing the organic intermediate layer.

In one embodiment of the present invention, the anode electrode 30 is formed to a thickness ranging from 1000 to 1500 Å while the first and second metal layers 30*a* and 30*b* are formed to have a similar thickness with respect to each other. For example, when the anode electrode 30 has a thickness of 1000 Å, each of the first and second metal layers 30*a* and 30*b* has a thickness of 500 Å.

The anode electrode 30 may be formed of a conductive and lustrous (reflective) metal containing, for example, aluminum.

In addition, disposed between the first and second substrates 10 and 12 are spacers 32 for uniformly maintaining a gap between the first and second substrates 10 and 12 against an outer force. The spacers 32 are arranged on the black layers 28 such that they do not overlap (interfere with) the phosphor layers 26.

In operation, the above-described electron emission display 100 is driven when one or more voltages (or predetermined voltages) are applied to the cathode, gate, focus, and anode electrodes 14, 18, 24 and 30.

For example, when the cathode electrodes 14 (or the gate electrodes 18) serve as scan electrodes for receiving one or more scan drive voltages, the other electrodes, i.e., the gate electrodes 18 (or the cathode electrodes 14), function as data electrodes for receiving one or more data drive voltages. The focusing electrode 24 receives a negative direct current voltage ranging, for example, from several to tens of negative volts. The anode electrode 30 receives a direct current voltage ranging, for example, from hundreds to thousands of positive volts to accelerate the electron beams.

Electric fields are formed around the electron emission regions 20 where a voltage difference between the cathode and gate electrodes 14 and 18 is equal to or higher than a threshold value, and thus the electrons are emitted from the electron emission regions 20. The emitted electrons collide with corresponding phosphor layers 26 of the corresponding pixel due to the high voltage applied to the anode electrode 30, thereby causing the phosphor layers 26 to emit light.

Figure 3:
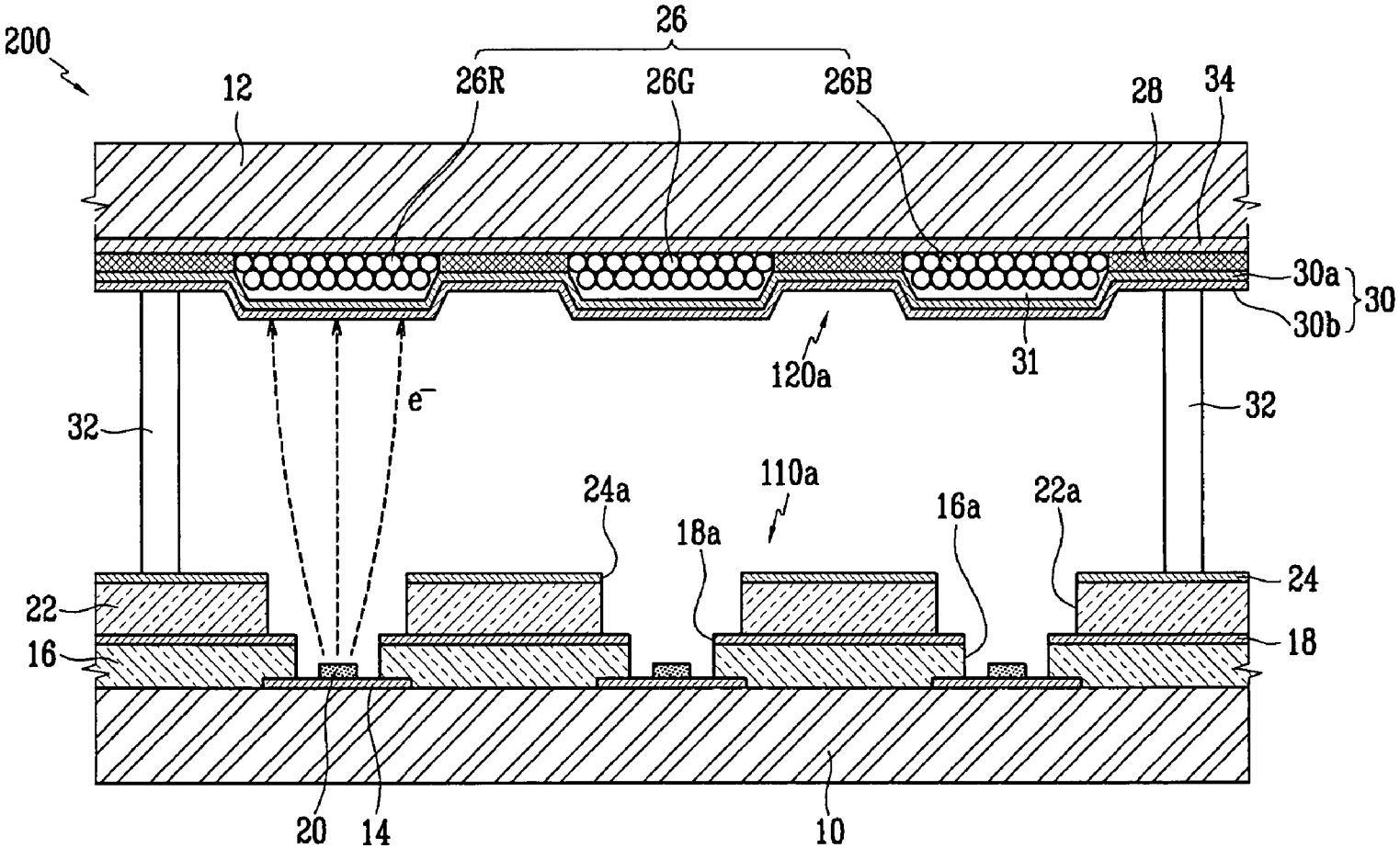
FIG. 3 is a partial sectional view of an electron emission display according to another embodiment of the present invention.

Referring to FIG. 3, an electron emission display 200 according to another embodiment of the present invention is shown. The electron emission display 200 of this embodiment is substantially identical to the embodiment of FIGS. 1 and 2 with the exception that a second anode electrode 34 is further formed.

The second anode electrode 34 is formed by a transparent conductive layer using, for example, indium tin oxide (ITO), rather than by the metal layer. The second anode electrode 34 is formed on surfaces of the phosphor and black layers 26 and 28 facing the second substrate 12.

Here, the second anode electrode 34 is electrically connected to the first anode electrode 30 that is formed of metal to maintain the high electric potential state of the phosphor layers 26. The second anode electrode 34 is integrated together with the first anode electrode 30 to function as a general (integrated) anode electrode of the electron emission display 200.

As in the embodiment of FIGS. 1 and 2, the second metal layer 30*b* is formed of one or more metal layers to compensate for the fine cracks formed on the first metal layer 30*a* during the fabricating process.

A method of fabricating the electron emission display according to an embodiment of the present invention will now be described with reference to FIGS. 4A through 4E.

Figure 4A:
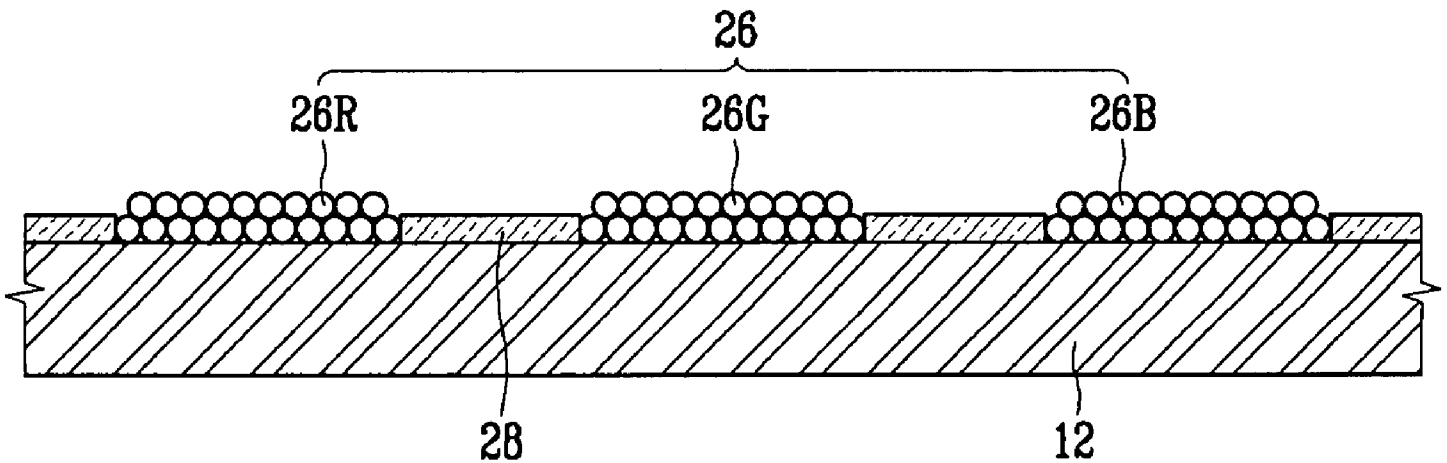
FIGS. 4A, 4B, 4C, 4D, and 4E are views illustrating a method of fabricating the electron emission display of FIG. 1 according to an embodiment of the present invention.

Referring first to FIG. 4A, the black layers 28 are formed on non-effective regions of the second substrate 12 and spaced apart from each other. The black layers 28 may be thin layers formed of chrome oxide or a thick layer formed of carbon-based material such as graphite. The red, green, and blue phosphor layers 26R, 26G, and 28B are formed on effective regions between the black layers 28.

Figure 4B:
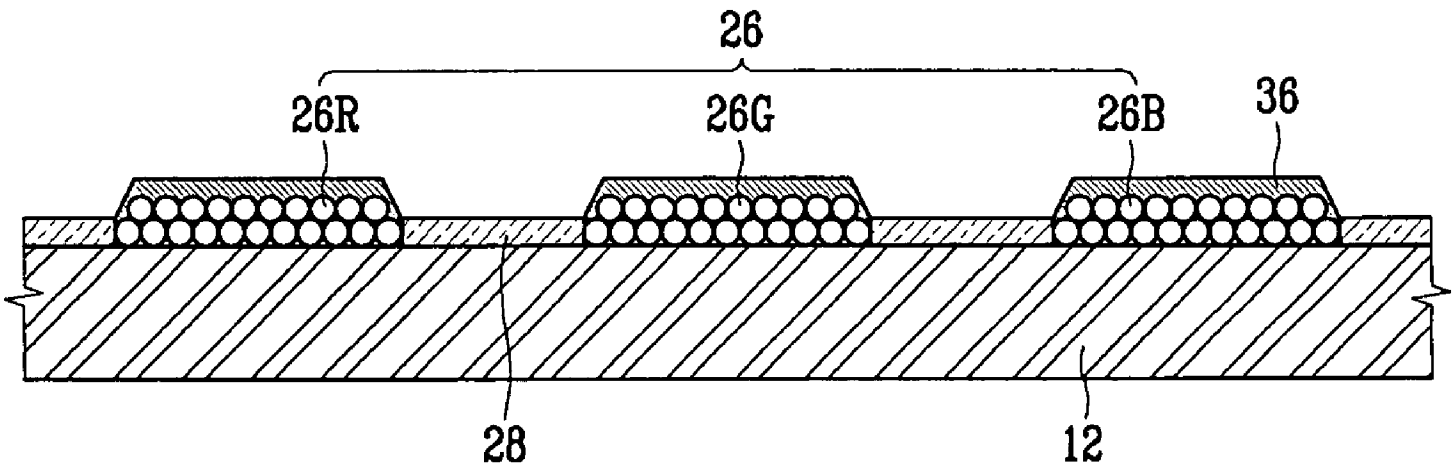

Then, as shown in FIG. 4B, an intermediate layer 36 is formed on (or over) the second substrate 12. Here, the intermediate layer 36 may be formed on only the phosphor layers 26 so that the anode electrode that will be formed in a following process can directly contact the black layers 28 to thereby enhance an attaching force of the anode electrode to the second substrate 12.

Figure 4C:
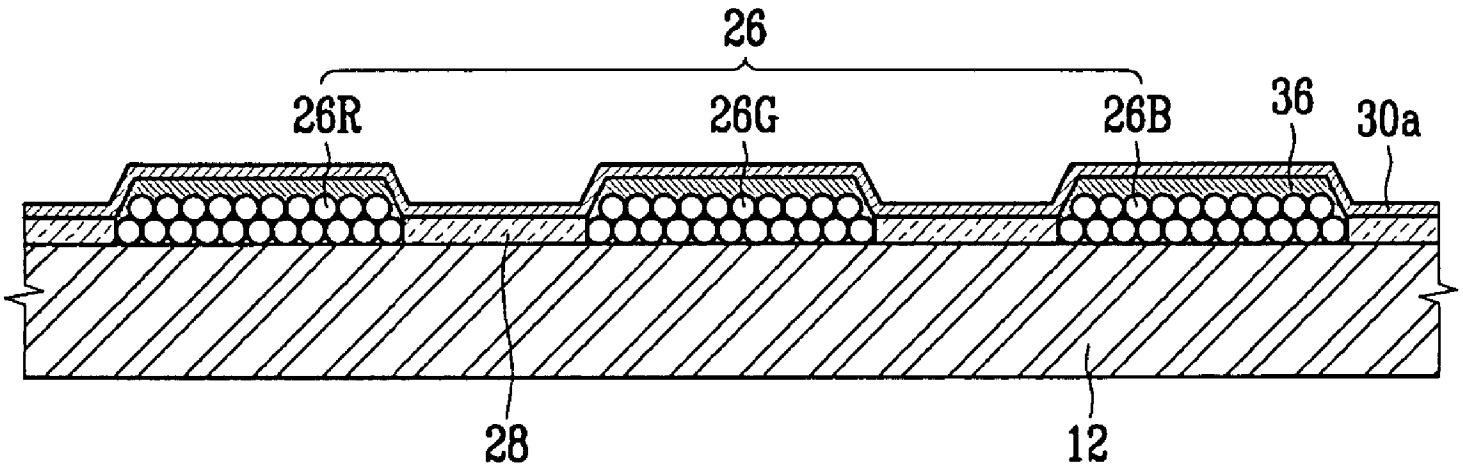

Next, as shown in FIG. 4C, a metal material such as aluminum is deposited on the black layers 28 and the intermediate layer 36 through a vapor deposition process or a sputtering process, thereby forming the first metal layer 30*a*.

Figure 4D:
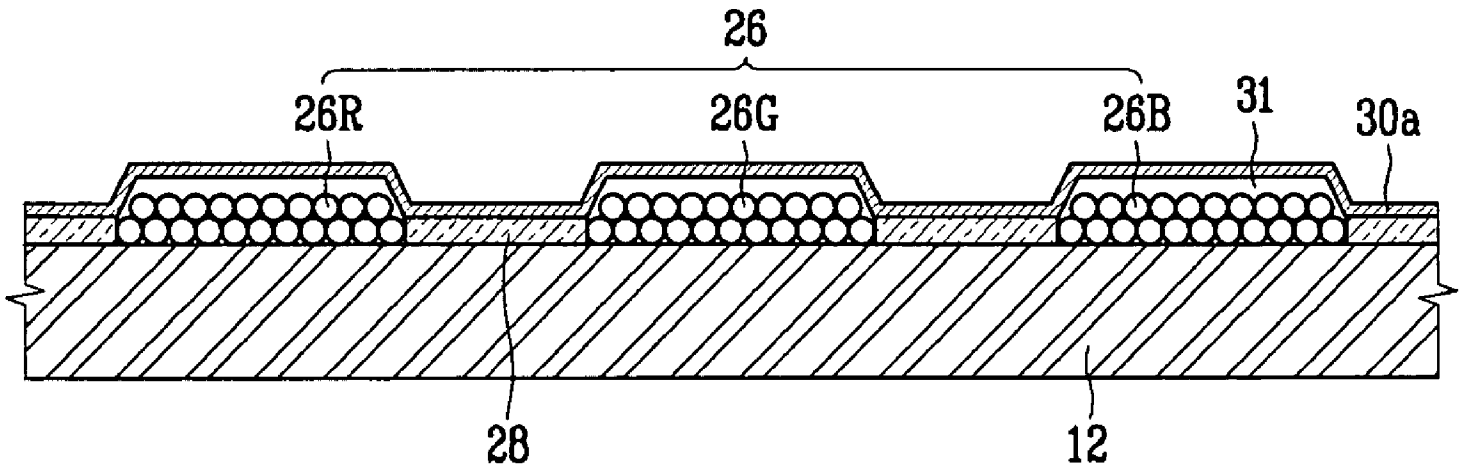

Referring to FIG. 4D, the second substrate 12 is fired to remove the intermediate layer 36. Here, the gap (or predetermined gap) 31 between the phosphor layers 26 and the first metal layer 30*a* is formed by the removal of the intermediate layer 36, and the first metal layer 30*a* directly contacts the black layers 28.

As the intermediate layer 36 is removed, the reflective efficiency of the light that is emitted from the phosphor layers 26 from the anode electrode 30 can be improved by the gap 31 formed between the first metal layer 30*a* and the phosphor layers 26.

Figure 4E:
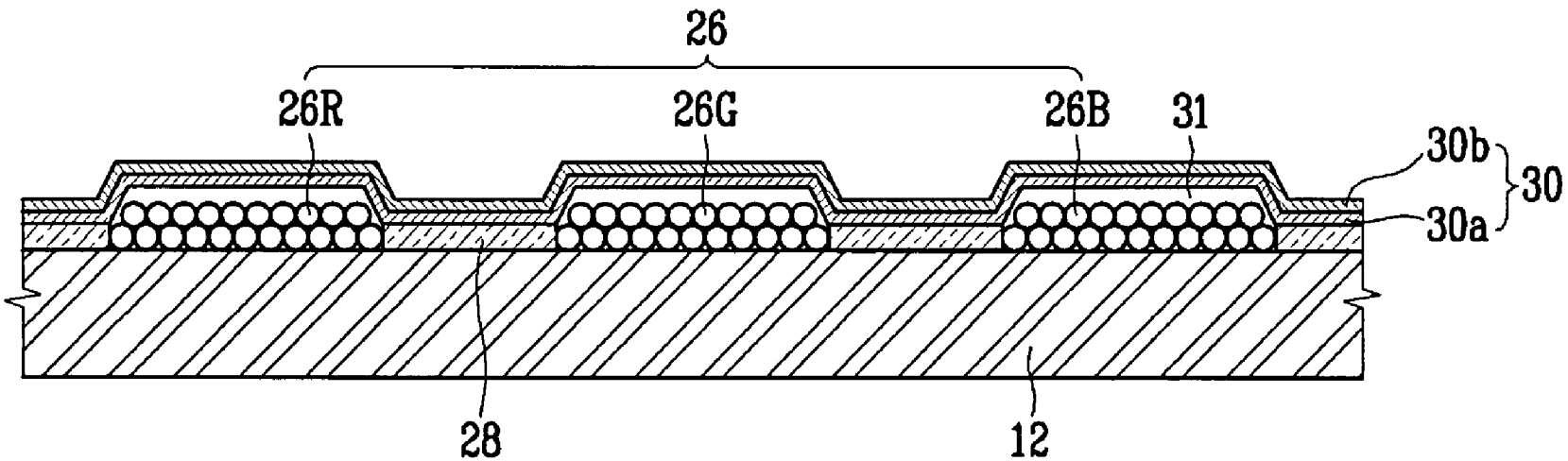

Next, as shown in FIG. 4E, a metal material such as aluminum is applied on the first metal layer 30*a* through a vapor deposition process or a sputtering process, thereby forming the second metal layer 30*b* and completing the anode electrode 30. When the first and second metal layers 30*a* and 30*b* are separately deposited to complete the anode electrode 30, the second metal layer 30*b* compensates for the fine (or hairline) cracks that may be formed on the first metal layer 30*a* of the anode electrode 30 during the process of firing the intermediate layer.

That is, even when fine cracks are formed on the first metal layer 30*a* during the process of firing the intermediate layer, the second metal layer 30*b* compensates for the cracks of the first metal layer 30*a* and thus the fine cracks are substantially. removed from the anode electrode 30 by the second metal layer 30*b* (or by the formation of the second metal layer 30*b*).

In order to further enhance the anode electrode 30, one or more additional metal layers may be further formed on the second metal layer 30*b*.

After the above processes, electron emission regions and driving electrodes for controlling the electron emission regions are formed on (or at) a first substrate and spacers are arranged between the first substrate and the second substrate 12. Then, the first substrate and the second substrate 12 are sealed together at their peripheries using a sealing material, and the inner space between the first substrate and the second substrate 12 is exhausted to complete an electron emission display (e.g., the electron emission display 100 of FIG. 1).

According an embodiment of to the present invention, since an anode electrode is formed to have a stable and secure structure (e.g., a laminated structure) as described above, it is resistant to damage even by electric shock. Thus, the luminescence and color reproduction quality of an electron emission display having the anode are improved, and the lifespan of electron emission display is enhanced.

In the above-described embodiments, although the electron emission display having an array of FEA elements is exemplified, the present invention is not thereby limited. That is, the present invention can be applied to electron emission display employing other types of electron emission elements.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission display device comprising:

a first substrate;

an electron emission unit at the first substrate to emit electrons;

a second substrate facing the first substrate; and a light emission unit at the second substrate to emit visible light using electrons emitted from the electron emission unit, wherein the light emission unit comprises a phosphor layer on the second substrate and an anode electrode on the phosphor layer, wherein the anode electrode comprises a first metal layer and a second metal layer on the first metal layer, wherein the second metal layer has a single- or multi-layered structure, wherein the anode electrode has a thickness ranging from about 1000 to 1500 Å, and wherein a gap is between the anode electrode and the phosphor layer.

2. The electron emission display device of claim 1, wherein each of the first metal layer and the second metal layer comprises a metal material containing aluminum.

3. The electron emission display device of claim 1, wherein the phosphor layer is divided into a plurality of sections arranged on the second substrate, and black layers are between the sections of the phosphor layer.

4. The electron emission display device of claim 1, further comprising another anode electrode between the second substrate and the phosphor layer.

5. The electron emission display device claim 1, wherein each of the first and second metal layers has a thickness ranging from about 500 to 750 Å.

6. An electron emission display device comprising:

a first substrate and a second substrate facing the first substrate; and a light emission unit at the first substrate, wherein the light emission unit comprises a phosphor layer on the first substrate and an anode electrode on the phosphor layer, wherein the anode electrode comprises a first metal layer and a second metal layer on the first metal layer adapted to compensate for cracks in the first metal layer, wherein the anode electrode has a thickness ranging from about 1000 to 1500 Å, and wherein the first metal layer is between the phosphor layer and the second metal layer and a gap is between the first metal layer and the phosphor layer.

7. The electron emission display device of claim 6, further comprising:

an electron emission unit at the second substrate to emit electrons, wherein the light emission unit is adapted to emit light using the electrons emitted from the electron emission unit.

8. The electron emission display device of claim 6, wherein the second metal layer has a single- or multi-layered structure.

9. The electron emission display device of claim 6, wherein each of the first metal layer and the second metal layer comprises a metal material containing aluminum.

10. The electron emission display device of claim 6, wherein the phosphor layer is divided into a plurality of sections arranged on the first substrate, and black layers are between the sections of the phosphor layer.

11. The electron emission display device of claim 6, further comprising another anode electrode between the first substrate and the phosphor layer.

12. The electron emission display device of claim 6, wherein the second metal layer is adapted to compensate for the cracks of the first metal layer formed by sintering of an intermediate layer between the phosphor layer and the first metal layer.

13. The electron emission display device of claim 12, wherein the intermediate layer is sintered to form a gap between the anode electrode and the phosphor layer.

14. The electron emission display device of claim 6, wherein each of the first and second metal layers has a thickness ranging from about 500 to 750 Å.

* * * * *

UNITED STATES PATENT AND TRADEMARK OFFICE

CERTIFICATE OF CORRECTION

PATENT NO. : 7,868,533 B2
APPLICATION NO. : 11/546780
DATED : January 11, 2011
INVENTOR(S) : Sang-Ho Jeon It is certified that error appears in the above-identified patent and that said Letters Patent is hereby corrected as shown below:

In the Claims

Column 7, Claim 5, line 19 After "device" Insert -- of --

Signed and Sealed this
Twenty-ninth Day of November, 2011

David J. Kappos

David J. Kappos
*Director of the United States Patent and Trademark Office*